US007420703B2

(12) United States Patent
Madsen et al.

(10) Patent No.: US 7,420,703 B2
(45) **Date of Patent: *Sep. 2, 2008**

(54) SYSTEM AND METHOD FOR FLIPPING A MEDIA SHEET

(75) Inventors: Jeffrey C. Madsen, Eagle, ID (US); Robert Jewell, Meridian, ID (US); Craig Hopper, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 783 days.

This patent is subject to a terminal disclaimer.

(21) Appl. No.: 10/419,473

(22) Filed: Apr. 21, 2003

(65) Prior Publication Data

US 2004/0208679 A1 Oct. 21, 2004

(51) Int. Cl.
*G06K 15/00* (2006.01)
*B65H 31/36* (2006.01)

(52) U.S. Cl. ..... 358/1.5; 271/222

(58) Field of Classification Search ..... 358/1.5, 358/1.12, 1.18, 3.32, 498; 270/45, 4, 37, 270/52.26, 52.29; 399/401, 392, 402, 388, 399/124, 116, 121, 316, 111; 347/104; 271/315, 271/187, 902, 68, 163, 275–276, 207, 110, 271/222, 183

See application file for complete search history.

(56) References Cited

U.S. PATENT DOCUMENTS 4,307,800 A 12/1981 Joa
4,693,464 A 9/1987 Honma
4,715,594 A 12/1987 Isobe et al.
5,013,026 A 5/1991 Howell
5,151,077 A * 9/1992 Cole et al. ..... 493/353
5,620,081 A 4/1997 Kivits
5,690,325 A 11/1997 Morimoto
5,732,623 A * 3/1998 Compera et al. ..... 101/232
6,443,450 B1 * 9/2002 Antinora ..... 271/315
6,601,952 B2 8/2003 Sugioka et al.
6,976,673 B2 * 12/2005 Madsen ..... 271/186
2002/0113356 A1 8/2002 Eugster et al.

(Continued)

FOREIGN PATENT DOCUMENTS

DE 32885 9/1885

(Continued)

OTHER PUBLICATIONS

Search Report for European Patent Application No. EP03023217, no date.

*Primary Examiner*—Saeid Ebrahimi Dehkordy

(57) ABSTRACT

A system and method for flipping a media sheet. The novel system (10) includes a first mechanism (12) for receiving and holding a media sheet (16) and a second mechanism (118) for rotating the first mechanism (12) about an axis parallel to a transverse axis of the media sheet (16). In an illustrative embodiment, the first mechanism (12) is comprised of a predetermined number of slots (14), each slot (14) adapted to receive and hold a media sheet (16). Inversion of a media sheet (16) is accomplished by inputting a sheet (16) with a leading edge and a trailing edge into a slot at an input position (18), rotating the first mechanism (12) until the slot is at an output position (20), and outputting the sheet (16) with the former trailing edge now leading.

6 Claims, 2 Drawing Sheets

U.S. PATENT DOCUMENTS

2002/0191065 A1* 12/2002 Temple et al. ..... 347/104

FOREIGN PATENT DOCUMENTS

| | | |
|---|---|---|
| DE | 558976 | 9/1932 |
| DE | 917764 | 9/1954 |
| DE | 10116481 | 10/2002 |
| EP | 1122198 | 8/2001 |
| JP | 59190140 | 10/1984 |
| JP | 02215638 | 8/1990 |
| JP | 2215638 | 8/1990 |
| JP | 2001-310503 | 11/2001 |

* cited by examiner

SYSTEM AND METHOD FOR FLIPPING A MEDIA SHEET

BACKGROUND OF THE INVENTION

1. Field of the Invention

The present invention relates to imaging systems. More specifically, the present invention relates to duplex printing.

2. Description of the Related Art

Image forming devices, such as printers and copiers, typically apply ink or toner to a media sheet—for example, a pre-cut sheet of paper—to form an image. Such devices may be adapted to form images on both of the opposing sides of the media sheet. This process is commonly referred to as duplex printing. The advantages of duplex printing include reducing the quantity of paper required for a print set as compared to one-sided (simplex) printing, and generating print sets with layouts resembling that of professionally printed books.

Conventional duplex printers require a mechanism—sometimes referred to as a duplexer—which can physically turn the media sheet over. After the sheet is printed on one side by a printing device, the duplexer flips the sheet over and then passes the sheet to either a second printing device or back to the same printing device that was used to print the first side of the sheet for second side printing.

A common method for flipping the media sheet involves diverting the sheet down a dead-end duplexing path, and then reversing the direction of motion of the sheet out of the duplexing path such that the former trailing edge of the sheet becomes the leading edge. Typically, the next sheet must wait until its predecessor has completely exited the duplexer before entering. This requires the gap between pages to be larger than the length of the sheet (assuming common speeds throughout the system). This excessive sized gap decreases sheet throughput, and cuts the performance limits of the system in half.

Additionally, most printing technologies require a minimum amount of time to transpire before the image-side of the media can be universally handled, i.e. for second side printing. This can also limit system performance.

Hence, a need exists in the art for an improved system or method for duplex printing which offers greater sheet throughput than prior art methods.

SUMMARY OF THE INVENTION

The need in the art is addressed by the system and method for flipping a media sheet of the present invention. The novel system includes a first mechanism for receiving and holding a media sheet and a second mechanism for rotating the first mechanism about an axis parallel to a transverse axis of the media sheet. In an illustrative embodiment, the first mechanism is comprised of a predetermined number of slots, each slot adapted to receive and hold a media sheet. Inversion of a media sheet is accomplished by inputting a sheet with a leading edge and a trailing edge into a slot at an input position, rotating the first mechanism until the slot is at an output position, and outputting the sheet with the former trailing edge now leading.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
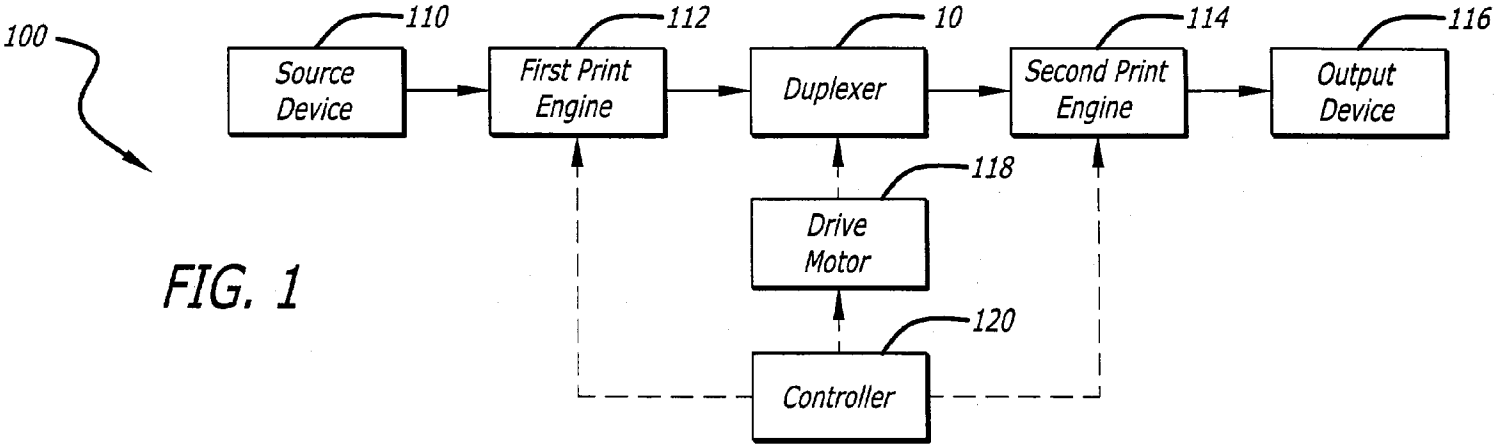
FIG. 1 is a simplified block diagram of a two-engine printing system designed in accordance with an illustrative embodiment of the present invention.

FIG. 1 is a simplified block diagram of a two-engine printing system 100 designed in accordance with an illustrative embodiment of the present invention. The printing system 100 includes a source device 110 which provides a plurality of media sheets that are to receive images thereon. The source device 110 directs a media sheet to a first print engine 112 configured to form an image on one side of the sheet. In the illustrative embodiment, after receiving an image on one side, the media sheet is flipped over by a duplexer 10 implemented in accordance with the teachings of the present invention. In the embodiment of FIG. 1, a second print engine 114 forms an image on the second side of the sheet. The sheet is then output to an output device 116. The novel duplexer 10 flips the media sheet by rotating it about an axis parallel to a transverse axis of the media sheet. A motor 118 is provided to drive the rotation of the duplexing device 10. A controller 120 controls the motor 118 and the print engines 112 and 114.

Figure 2:
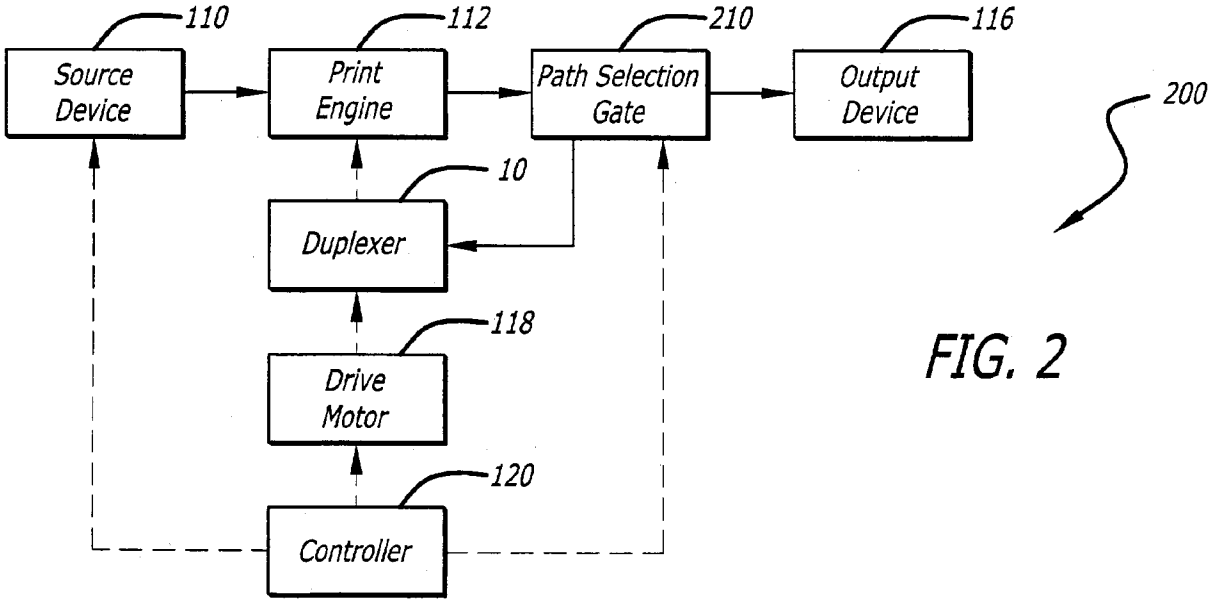
FIG. 2 is a simplified block diagram of a one-engine printing system designed in accordance with an illustrative embodiment of the present invention.

FIG. 2 is a simplified block diagram of a one-engine printing system 200 designed in accordance with an illustrative embodiment of the present invention. The printing system 200 includes a source device 110 which provides a plurality of media sheets that are to receive images thereon. The source device 110 directs a media sheet to a print engine 112 configured to form an image on one side of the sheet. After receiving an image on one side, a path selection gate 210 directs the media sheet to a duplexer 10 implemented in accordance with the teachings of the present invention. The media sheet is flipped over by the duplexer 10 and directed back to the print engine 112 for printing the second side of the sheet. The path selection gate 210 then outputs the sheet to an output device 116. A motor 118 is provided to drive the rotation of the duplexing device 10. A controller 120 controls the motor 118, the print engine 112, and the path selection gate 210.

Figure 3:
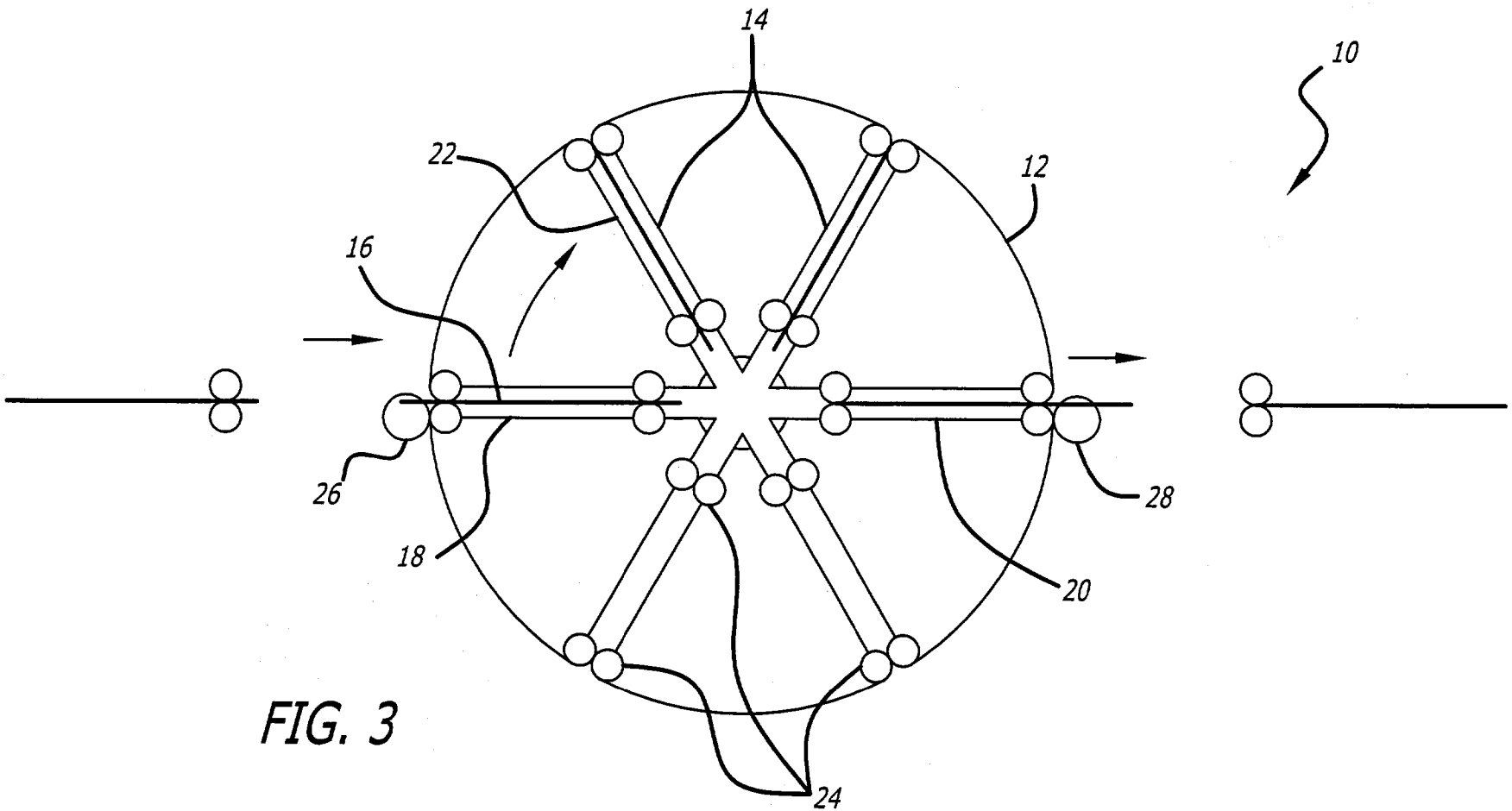
FIG. 3 is a cross-sectional view of a duplexing device designed in accordance with an illustrative embodiment of the present invention.

FIG. 3 is a cross-sectional view of a duplexing device 10 designed in accordance with an illustrative embodiment of the present invention. The novel duplexer 10 includes a first mechanism 12 comprised of a predetermined number of slots 14, each slot 14 adapted to receive and hold a media sheet 16. In the illustrative embodiment, the mechanism 12 is shaped like a "wagon wheel", with each slot 14 oriented along a radius of the wheel 12. The mechanism 12 is adapted to rotate about an axis that lies in the plane of the media sheet 16 and is perpendicular to the paper transport direction (parallel to a transverse axis of the sheet). In the illustrative example shown in FIG. 3, the wheel 12 rotates clockwise about an axis coming out of the paper through the center of the wheel. The duplexer 10 also includes a mechanism for rotating the wheel 12. In the illustrative embodiments, a controller 120 operates through a drive motor 118 (shown in FIGS. 1 and 2) to cause the wheel 12 to be selectively rotated.

Inversion of a media sheet 16 is accomplished by receiving a sheet 16 into a slot at an input position 18, rotating the mechanism 12 until the slot is in an output position 20, and outputting the sheet 16 at the output position 20. Manipulation of a sheet in this fashion results in the former trailing edge of the sheet becoming the new leading edge. In the illustrative embodiment of FIG. 3, the sheet 16 enters from the left into a slot oriented in the nine o'clock position, and exits to the right from the same slot, but oriented in the three o'clock position. Other input and output locations may be chosen without departing from the scope of the present invention. The input and output locations do not necessarily need to be on opposite sides. For some applications, it may be advantageous, for example, to have an input at nine o'clock and output at 12 o'clock.

In the illustrative embodiment, the duplexer 10 is shown with six slots 14. However, the invention is not limited to the number of slots 14 in the rotating mechanism 12. The mechanism 12 can have one, two, or more slots 14 without departing from the scope of the present teachings. The mechanism 12 may have a significantly larger number of slots, the number of slots being limited only by potential interference of the components of adjacent slots. In its simplest form, the mechanism 12 has a single slot and is rotated about an axis near the middle of the slot. A media sheet enters the slot, is rotated 180 degrees, and immediately exits the slot. The invention, however, has more advantages when two or more slots are incorporated into the rotating apparatus 12.

When the mechanism 12 has multiple slots 14, one media sheet can enter a slot at the input position 18, while another sheet simultaneously exits from a slot at the output position 20. If the mechanism 12 has more than two slots, a slot does not rotate immediately from the input position 18 to the output position 20. It stops at one or more intermediate positions. For example, in the illustrative embodiment of FIG. 3 (which has six slots 14), after a first media sheet enters a first slot at the input position 18 (nine o'clock), the wheel 12 rotates to orient the next slot at the input position 18. The first media sheet remains in the first slot which is now at the first intermediate position 22 (eleven o'clock in the example), and the next media sheet enters the slot which is now at the input position 18. The wheel 12 continues to rotate in this fashion, stopping at each indexing point to allow a sheet to enter at the input position 18 and a sheet to exit at the output position 20. Media sheets thus have time to dry while they are in the intermediate positions between the input and output positions.

This method allows the gap between media sheets to be much smaller than the length of a sheet (as is required by prior art methods). The gap between sheets is determined by the time needed to rotate from one position to the next. An additional advantage is that dry time can be provided to whatever extent is desired (up to a certain limit) by increasing the number of slots in the mechanism 12. The larger the number of slots, the smaller the angular travel necessary between sheets (reducing the head-to-tail distance between pages and increasing throughput), and the longer dry time offered to each sheet (due to the greater number of cycles between entering the duplexer and exiting the duplexer).

The slots 14 may include nip rollers 24 for inputting and outputting sheets 16, and holding sheets 16 in place. These nip rollers 24 should be powered at the input and output positions, but stationary at all other points (to hold the media in place during rotation of the wagon wheel 12). The rotational power of these rollers 24 can be provided in a number of ways including (but not limited to) a friction drive wheel 26 (which does not rotate with the wagon wheel 12) which engages with one of the nip rollers 24 of a slot oriented at the input position 18, and another friction drive wheel 28 which does the same at the output position 20. The motion of these motors (and rollers), as well as the rotation of the wagon wheel, should be carefully controlled to start and stop as needed.

Each slot should be at least as long as the longest media type required. The number of slots determines the angular rotation of the wheel for each cycle.

The duplexer 10 may optionally include an operational mode for simplex printing. When flipping of the media sheet is not required, the wheel 12 remains stationary, and internal nip rollers 24 guide sheets straight through the mechanism 12 from the input position 18 to the output position 20. This embodiment requires a clear path from the input slot to the output slot (i.e. a hollow center).

An edge sensor (not shown) can be employed upstream of the rotating mechanism 12 to provide trailing edge information, to ensure that a media sheet is properly positioned in the input slot (with the new leading edge being a predetermined distance from the nip rollers which reside in each slot).

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A duplexer comprising:

a first mechanism comprised of a predetermined number of slots, each slot adapted to receive and hold a media sheet, wherein said slots include a plurality of nip rollers to hold said media sheets in place;

a second mechanism for inputting a media sheet with a leading edge and a trailing edge into a first slot at an input position;

a third mechanism for rotating said first mechanism about an axis parallel to a transverse axis of said media sheet such that said first slot moves to an output position; and a fourth mechanism for outputting said media sheet leading with said trailing edge from said first slot at said output position, wherein each slot has a length at least as long as the media sheet.

2. The duplexer of claim 1 wherein said second mechanism inputs a first sheet while said fourth mechanism outputs a second sheet.

3. The duplexer of claim 1 wherein said slots are oriented along a radius of said first mechanism.

4. The duplexer of claim 1 wherein said second mechanism includes a friction drive wheel adapted to engage with one of the nip rollers of a slot oriented at said input position.

5. The duplexer of claim 1 wherein said fourth mechanism includes a friction drive wheel adapted to engage with one of the nip rollers of a slot oriented at said output position.

6. The duplexer of claim 1 wherein said first mechanism includes a clear path from a slot oriented in the input position to a slot oriented in the output position.

* * * * *

UNITED STATES PATENT AND TRADEMARK OFFICE

CERTIFICATE OF CORRECTION

PATENT NO. : 7,420,703 B2
APPLICATION NO. : 10/419473
DATED : September 2, 2008
INVENTOR(S) : Jeffrey C. Madsen et al.

It is certified that error appears in the above-identified patent and that said Letters Patent is hereby corrected as shown below:

Title Page,
On page 2, (56), under "Foreign Patent Documents", column 2, line 5, delete "JP 2215638 8/1990".

Signed and Sealed this

Twenty-third Day of December, 2008

JON W. DUDAS
*Director of the United States Patent and Trademark Office*